US007308219B2

(12) United States Patent
Shishido

(10) Patent No.: US 7,308,219 B2
(45) Date of Patent: Dec. 11, 2007

(54) IMAGE HEATING APPARATUS INCLUDING AN ENDLESS BELT AND BELT COOLING MECHANISM

(75) Inventor: Kazuo Shishido, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 11/249,457

(22) Filed: Oct. 14, 2005

(65) Prior Publication Data

US 2006/0083536 A1 Apr. 20, 2006

(30) Foreign Application Priority Data

Oct. 20, 2004 (JP) ..... 2004-305245

(51) Int. Cl.
*G03G 15/20* (2006.01)

(52) U.S. Cl. ..... 399/92; 399/329

(58) Field of Classification Search ..... 399/92, 399/329, 320, 91
See application file for complete search history.

(56) References Cited

U.S. PATENT DOCUMENTS

| | | | | |
|---|---|---|---|---|
| 4,745,432 | A * | 5/1988 | Langdon | 399/250 |
| 6,871,040 | B2 * | 3/2005 | Tani et al. | 399/329 |
| 2006/0083536 | A1 | 4/2006 | Shishido | 399/92 |

FOREIGN PATENT DOCUMENTS

| | | | |
|---|---|---|---|
| JP | 5-27629 | | 2/1993 |
| JP | 05072926 | A * | 3/1993 |
| JP | 5-303300 | | 11/1993 |
| JP | 2001083826 | A * | 3/2001 |
| JP | 2001-201979 | | 7/2001 |
| JP | 2002-174972 | | 6/2002 |
| JP | 2002-365946 | | 12/2002 |
| JP | 2004151476 | A * | 5/2004 |

* cited by examiner

*Primary Examiner*—Quana Grainger
(74) *Attorney, Agent, or Firm*—Fitzpatrick, Cella, Harper & Scinto

(57) ABSTRACT

The invention aims to prevent an image deterioration resulting from a fixing belt rising in temperature too much, and prevent heat of the fixing belt from being transmitted to peripheral members around a fixing apparatus such as a photosensitive drum so as not to adversely effect the peripheral members. A fixing apparatus 5 has a fixing roller 510 and a fixing belt 531 that heat-fix an image on to a recording material P by a fixing nip W, partition walls 601 to 605 that surround the fixing belt 531 to thereby suppress the air naturally entering into around the fixing belt 531, and a cooling unit that cools the fixing belt 531 in a closed space 600 formed by the partition walls 601 to 605. The cooling unit has a supply duct 612 through which a supply fan 613 supplies air to the closed space 600 from below, a cooling fan 611 that blows the air supplied from the supply duct 612 toward the fixing belt 531, and a discharge duct 614 through which a discharge fan 615 discharges the air from an upper portion of the closed space 600.

7 Claims, 6 Drawing Sheets

IMAGE HEATING APPARATUS INCLUDING AN ENDLESS BELT AND BELT COOLING MECHANISM

CROSS-REFERENCE TO RELATED APPLICATION

This application claims the benefit of priority from the prior Japanese Patent Application No. 2004-305245 filed on Oct. 20, 2004 the entire contents of which are incorporated by reference herein.

BACKGROUND OF THE INVENTION

1. Field of the Invention

The present invention relates to an image heating apparatus for heating an image formed on a recording material. This image heating apparatus includes, as examples, a fixing apparatus used for an image forming apparatus such as a copy machine, a facsimile, a printer, and the like.

2. Related Background Art

An electrophotographic type image forming apparatus such as a copy machine, a printer, etc. has a fixing apparatus for heating, melting, and then fixing a not-yet-fixed toner image, which is formed corresponding to an image information, on to a recording material such as a plain paper, a coated paper, an OHP sheet, and the like.

As disclosed in Japanese Patent Application Laid-Open No. 2001-201979, there has been known a belt-nip type fixing apparatus which causes a pressure body to pressure-contact a fixing rotational member with heating means, and causes a recording material to pass through a fixing nip mentioned below. Thereby not-yet-fixed toner image formed on the recording material is fixed. The pressure body is constituted by an endless belt rotatably engaged with a plurality of supporting rollers, a pressure member fixedly disposed inside of the endless belt so as to pressure-contact the endless belt toward the fixing rotational member from inside. The above-mentioned fixing nip is formed between the fixing rotational member and the pressure member (between the fixing rotational member and the endless belt pressure-contacting the pressure member).

In a case where the above-mentioned image forming apparatus continuously forms the image on the recording material, the recording material passes through the fixing nip, which is formed between the fixing rotational member and the endless belt, with a predetermined interval (hereinafter referred to as "the interval-between-papers". To this end, during the interval-between-papers in which the recording material is not within the fixing nip, the endless belt undergoes a surplus heat from the fixing rotational member, so that the temperature increases all over the endless belt too much, which may unfavorably lead to a disturbance of the not-yet-fixed toner image formed on the recording material.

Further, when the recording material continuously passing therethrough has a width less than the maximum width (the maximum length with respect to a direction perpendicular to the conveying direction) of the recording material which is capable of passing through the fixing nip, the endless belt rises in temperature much higher at its non-sheet-passing portion than at its sheet-passing portion, thereby causing a surface of the endless belt to be subjected to a temperature unevenness with respect to its longitudinal direction (a width direction perpendicular to the conveying direction). This may lead an evenness of temperature melting the not-yet-fixed toner image to thereby deteriorate the image, or an evenness of a friction coefficient of the fixing nip to thereby deteriorate the image. Such a problem relating to a false image occurs markedly in the case of the recording material of a coated paper, a thick paper, or the like.

To the above-mentioned image deterioration due to the endless belt rising in temperature too much, a cooling apparatus such as a blower fan, and the like is conventionally disposed in the vicinity of the endless belt to thereby forcibly cool the endless belt, as shown in Japanese Patent Application Laid-Open No. 2001-201979.

However, in these days, the image forming apparatus is required for the speeding up and the miniaturization space-saving, which causes the fixing apparatus and the image forming apparatus to come close to each other. In the construction disclosed in Japanese Patent Application Laid-Open No. 2001-201979, hot air of the fixing apparatus reaches the image forming unit being a peripheral member of the fixing apparatus, which provides another problem such as a blocking, and the like, in which the toner on the photosensitive drum in the image forming unit unfavorably melts and hence adheres thereto.

SUMMARY OF THE INVENTION

According to the present invention, it is an object to provide an image heating apparatus which is capable of cooling a belt efficiently.

In order to attain the above object, there is provided an image heating apparatus comprising a heating rotational member that heats an image on a recording material at a heating nip; an endless belt that forms the heating nip in association with the heating rotational member; a partition wall that surrounds the belt so as to partition the belt with the heating rotational member and suppresses air naturally entering thereinto; and a cooling unit which cools the belt in a closed space formed by the partition wall.

Another object of the invention will become apparent by reading the detailed description mentioned below with reference to the drawings.

DETAILED DESCRIPTION OF THE PREFERRED EMBODIMENTS

The invention will now be demonstratively described in detail with reference to the drawings showing a preferred embodiment thereof. Constituent elements in the embodiment described below may be suitably modified in size, material, shape, and relative configuration according to a construction of the apparatus to which the invention is applied and various kinds of conditions; accordingly, it should be understood that the scope of the invention is not limited only to the embodiment described below, unless otherwise specified.

Figure 2:
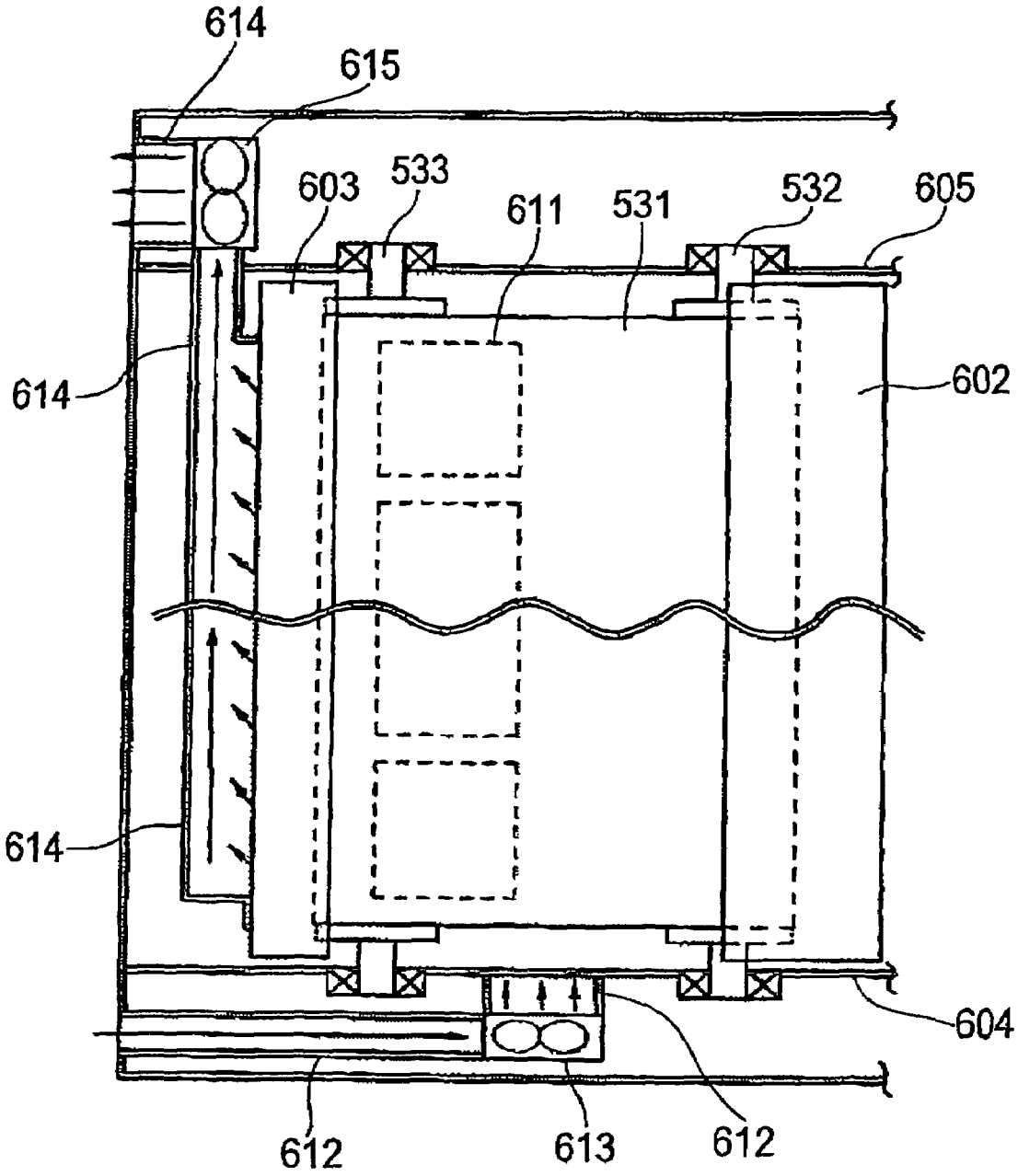
FIG. 2 is a top plan view of a fixing apparatus according to an embodiment of the invention.
Figure 3:
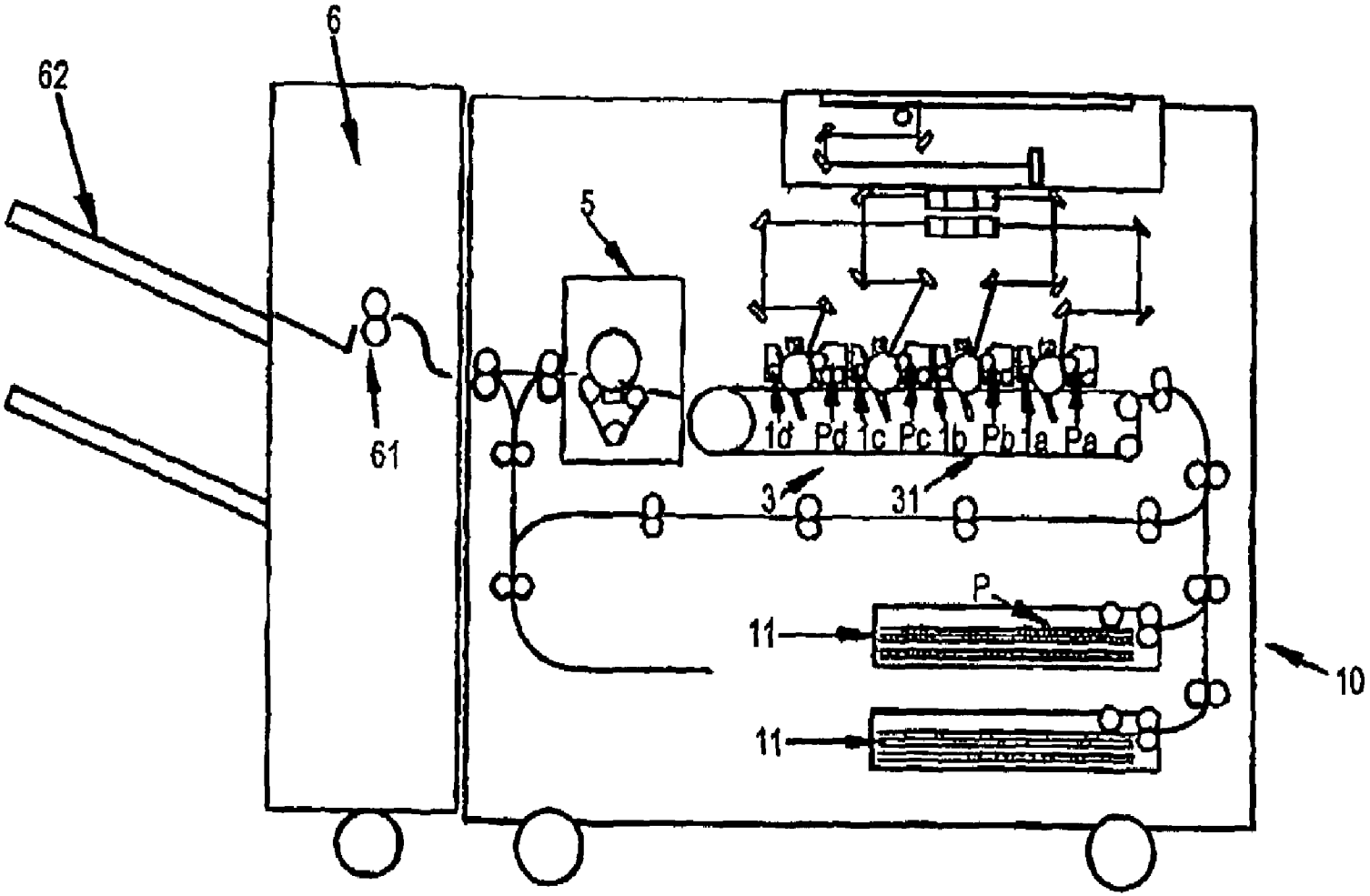
FIG. 3 is a main sectional view of an image forming apparatus according to an embodiment of the invention.
Figure 4:
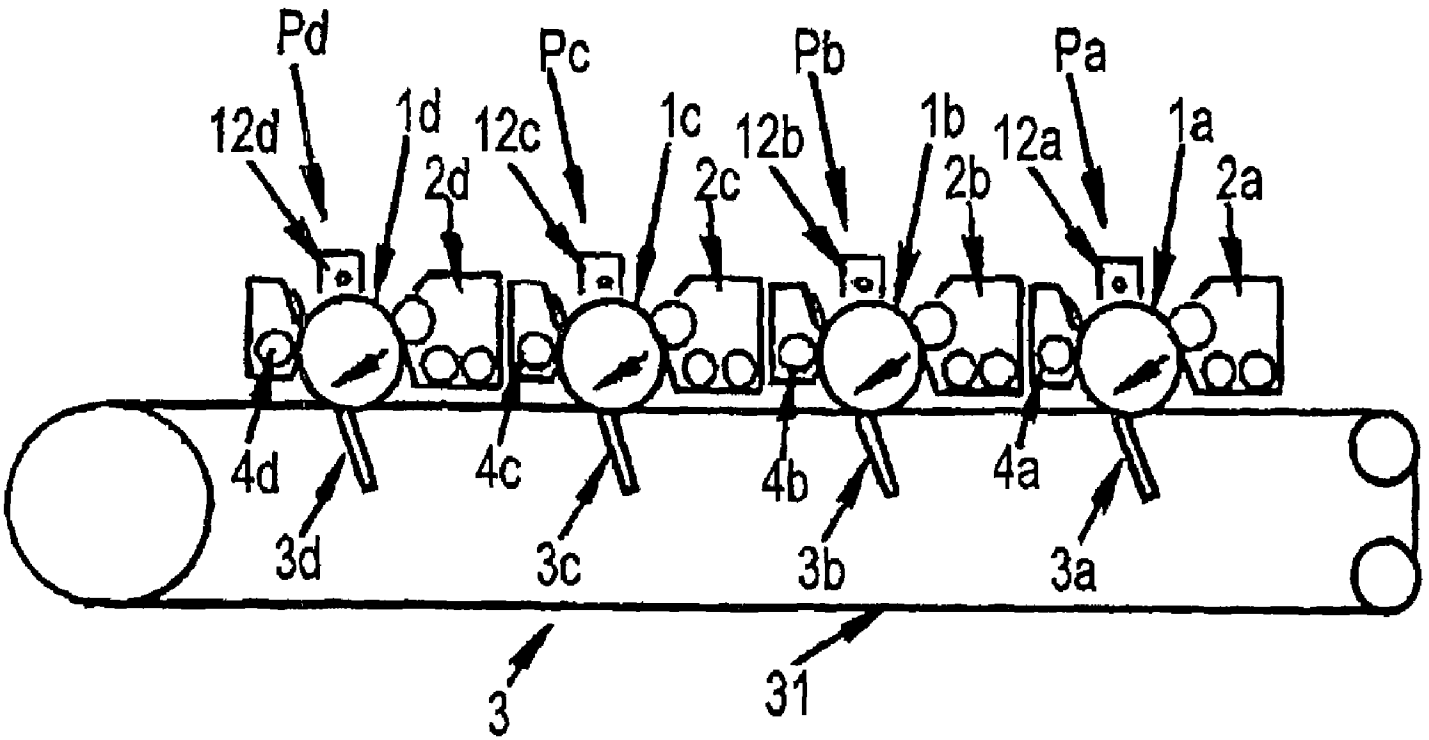
FIG. 4 is a partial sectional view of an image forming unit according to an embodiment of the invention.

There is first illustrated the outline structure of an image forming apparatus with reference to FIGS. 3 and 4. Then, there are illustrated a construction of a fixing apparatus, as an image heating apparatus, with reference to FIGS. 5 and 6, and further a cooling unit of the fixing apparatus with reference to FIGS. 1 and 2, respectively.

FIGS. 3 and 4 exemplify a four drum-laser beam printer, as an image forming apparatus, having a plurality of optical scanning units, in which FIG. 3 is a sectional view of the image forming apparatus, and FIG. 4 is a sectional view of an image forming unit of the image forming apparatus. As shown in FIG. 3, in a main body of the image forming apparatus are juxtaposed four image forming stations Pa, Pb, Pc, and Pd, as image forming means.

The above-mentioned stations Pa, Pb, Pc, and Pd form respective colors of magenta, cyan, yellow, and black, respectively. These stations have photosensitive member drums 1*a*, 1*b*, 1*c*, and 1*d*, as image bearing members, which are rotated in the arrow direction, as shown in FIG. 4.

Further, around the respective photosensitive drums 1*a*, 1*b*, 1*c*, and 1*d*, chargers 12*a*, 12*b*, 12*c*, and 12*d*, developers, 2*a*, 2*b*, 2*c*, and 2*d*, and cleaners 4*a*, 4*b*, 4*c*, and 4*d*, as process means, acting on the photosensitive drums are disposed sequentially in the rotational directions of the photosensitive drums 1*a*, 1*b*, 1*c*, and 1*d*, respectively.

Besides, below the respective photosensitive drums 1*a*, 1*b*, 1*c*, and 1*d* is disposed a transfer unit 3. This transfer unit 3 has a transfer belt 31, as a recording material conveying means, commonly used for the respective image forming stations Pa, Pb, Pc, and Pd, and transferring chargers 3*a*, 3*b*, 3*c*, and 3*d*.

In the above-mentioned image forming apparatus, as shown in FIG. 3, a recording material P is supplied from one of sheet cassettes 11 by a recording material supplying unit 10 composed of feeding rollers, or the like. This recording material P is supported on the transfer belt 31 and simultaneously conveyed sequentially to the respective image forming stations Pa to Pd, where toner images of respective colors formed on the respective photosensitive drums 1*a* to 1*d* are transferred on to the transfer belt 31, respectively.

After finished this transfer process, the recording material P is separated from the transfer belt 31 and then conveyed to a fixing apparatus 5.

The not-yet-fixed toner images transferred on to the recording material P is fixed onto the recording material P due to the heat and pressure by the fixing apparatus 5. The recording material P having a fixed image thereof is conveyed to a sheet processing apparatus 6 mounted to the main body of the image forming apparatus. The sheet processing apparatus 6 is adapted to discharge the recording material P on to an discharge tray 62 through conveyance rollers 61. The discharge tray 62 is adapted to move downward, thereby enabling a number of the recording materials P to be stacked on the discharge tray 62. Moreover, the sheet processing apparatus 6 is capable of suitably selectively carrying out a processing including a stapling of a number of the recording materials P.

Figure 5:
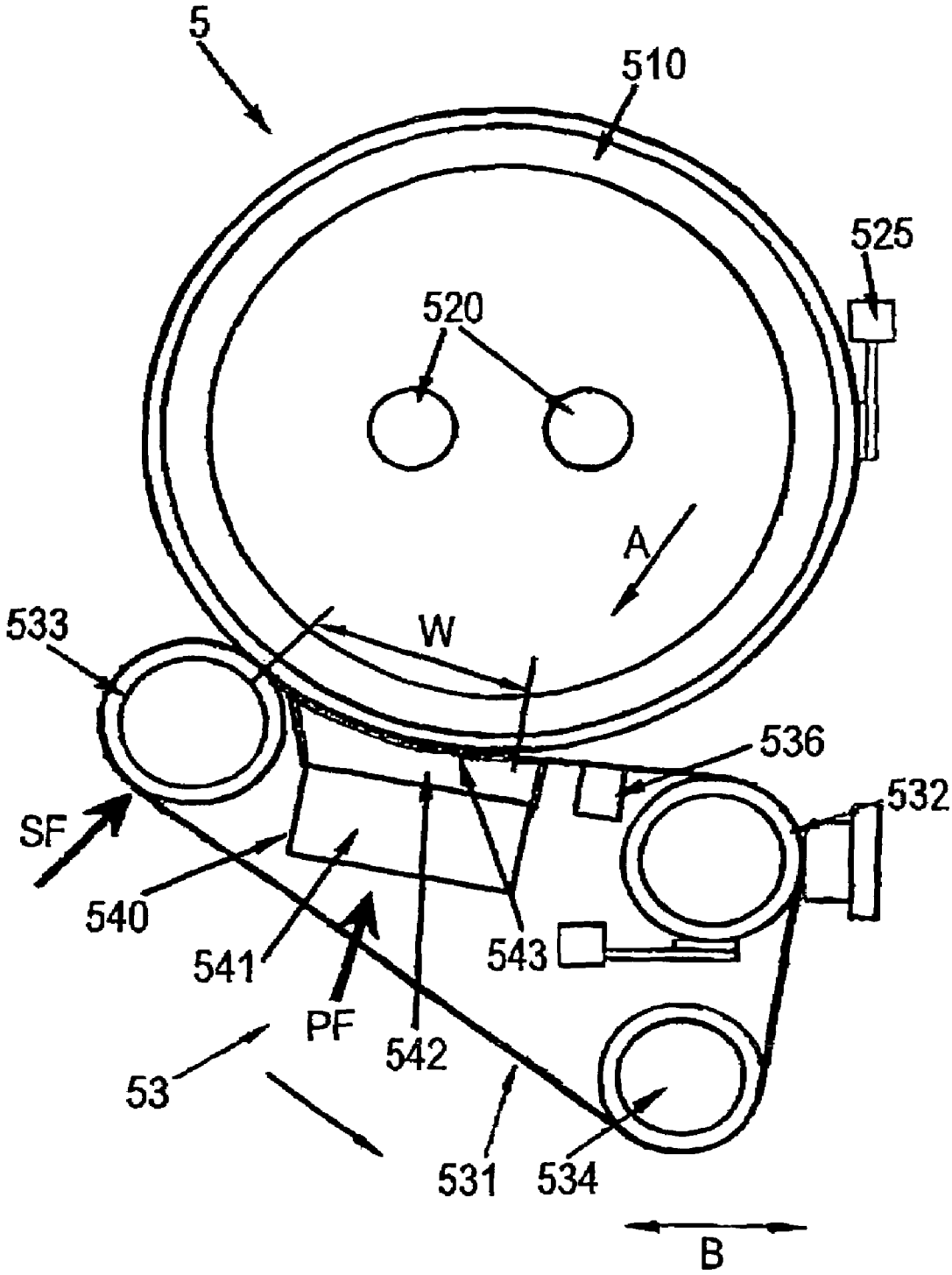
FIG. 5 is a main sectional view of a fixing apparatus according to an embodiment of the invention.

In the above-mentioned image forming apparatus, the fixing apparatus 5 has, as shown in FIG. 5, a fixing roller 510, as a heating rotational member (fixing rotational member), rotatably arranged. The fixing roller 510 is rotated in the direction of an arrow A by a driving source (not show)), heated by halogen heaters 520, as heating means, disposed therein, and controlled so as to be heated up to a predetermined temperature by a thermister 525 disposed on a surface of the fixing roller 510.

Further, the fixing apparatus 5 has a belt unit 53 including an endless-like fixing belt 531, as a pressure rotational member. The fixing belt 531 is disposed below the fixing roller 510 and forms a fixing nip, as a heating nip, for nipping, conveying, and heating the recording material P, in association with the fixing roller 510. The belt unit 53 further has a fixing belt 531, as a pressure belt (an endless belt) which is engaged with the plurality of supporting rotational members, that is, the inlet roller 532, the separating roller 533, and the steering roller 534.

The separating roller 533 is made of a metal such as SUS, and the like, and is urged in the direction of an arrow SF to thereby be pressure-contacted to the fixing roller 510 through the fixing belt 531. A longitudinal direction, wise one end of the steering roller 534 is movable in the direction of an arrow B, thereby causing a longitudinal direction (a width direction perpendicular to the conveying direction)-wise offset of the fixing belt 531 to be corrected.

Further, the belt unit 53 has a pressure pad unit 540, as a pressure member, for pressure-contacting the fixing belt 531 to the fixing roller 510 from the inside of the fixing belt 531.

The pressure pad unit 540 is arranged between the inlet roller 532 and the separating roller 533, and pressure-contacts the fixing belt 531 to the fixing roller 510 from the inside of the fixing belt 531. The pressure pad unit 540 is constituted of a base 541 made of a metal such as SUS and the like, and a pressure pad 542 made of a silicone robber and the like, and attached to an upper portion of the base 541, and a sliding sheet 543 made of a PI film and the like, arranged between the pressure pad 542 and the fixing belt 531, and pressure-contacted to the fixing roller 510 in the direction of an arrow PF through the fixing belt 531.

Moreover, between the inlet roller 532 and the pressure pad unit 540 is disposed an oil felt 536. This oil felt 536 has a silicone oil impregnated therein, and further an oil is applied to the inside of the fixing belt 531, thereby decreasing a friction force between the fixing oil 531 and the sliding sheet 543.

Figure 6:
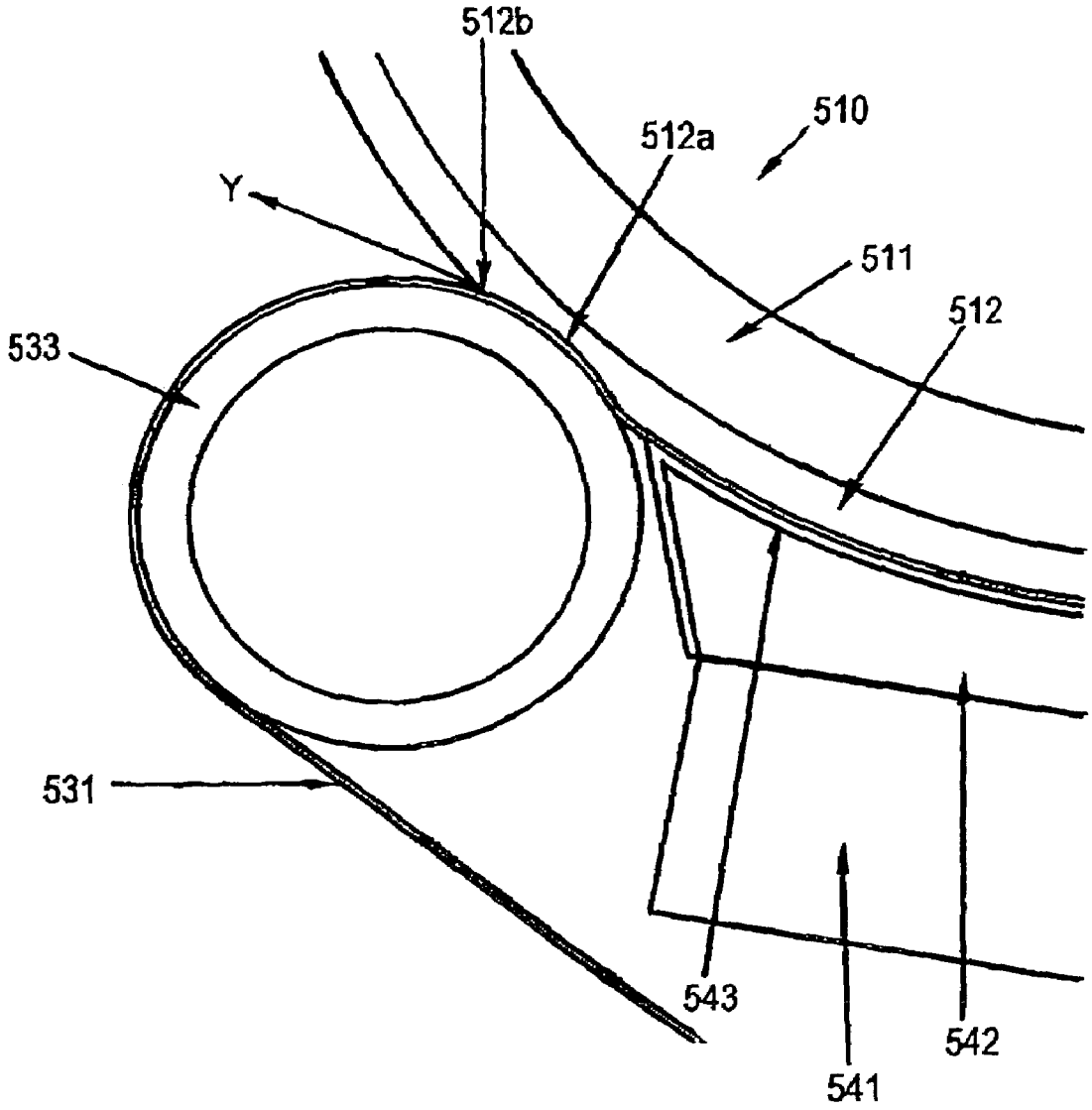
FIG. 6 is an enlarged partial sectional view of a fixing apparatus according to an embodiment of the invention.

FIG. 6 is an enlarged view of the vicinity of the separating roller.

The fixing roller 510 has a cored bar 511 made of a metal such as aluminum and the like, and a resilient layer 512 made of silicon rubber and the like and disposed on a surface of the cored bar 510. The separating roller 533 made of a metal is pressed toward the fixing roller 510 through the fixing belt 631 by pressure means (not shown), which causes a portion 512*a* of the resilient layer 512 of the fixing roller 510 to be deformed in so as to be shape along an arc shape of the separating roller 533. The not-yet-fixed toner image on the recording material P is molten and pressed by a nip W of the fixing apparatus 5, thereby causing the toner and the surface layer of the fixing roller to be adhered to each other due to the surface tension.

However, as described above, the portion 512*a* of the resilient layer 512 of the fixing roller 510 toward which is pressed the separating roller 533 is shaped along the arc shape of the separating roller 533, thereby causing the toner adhered to the fixing roller 510 to be exfoliated at a portion 512*b* downstream of the portion 512*a* of the resilient layer, which causes the recording material P to be discharged in the direction of an arrow Y.

As described above, the belt-nip type fixing apparatus 5 forms the nip Win association with the fixing roller 510, the fixing belt 531, and the pressure pad unit 549, and the separating roller 533, thereby making a width (a conveying direction-wise length) of the nip W wide, which enables the not-yet-fixed toner image on the recording material to be molten during the long time. This construction is suitable for an image forming apparatus which uses plenty of color toner, like a color image forming apparatus.

Figure 1:
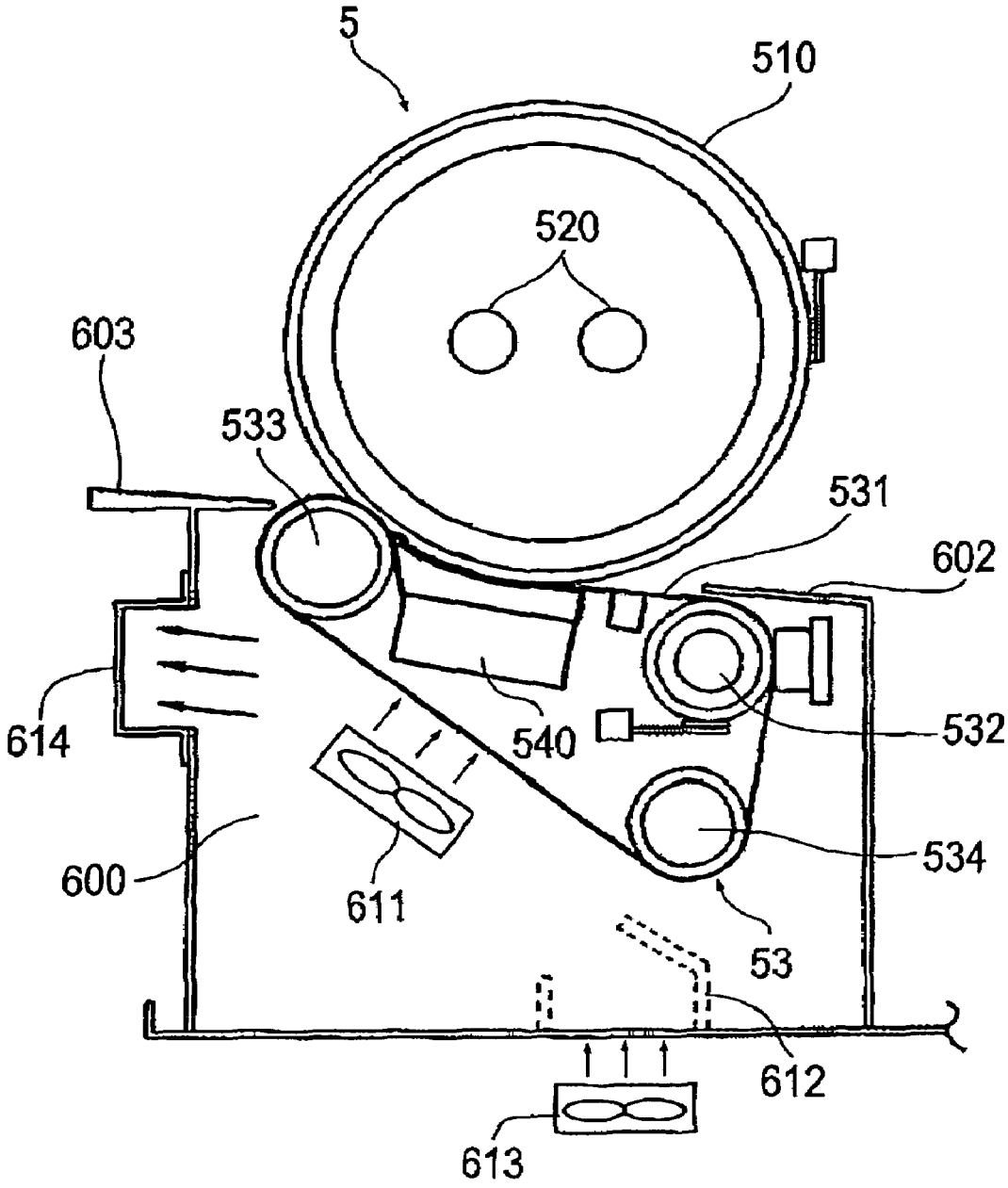
FIG. 1 is a main sectional view of a fixing apparatus according to an embodiment of the invention.

Next, referring to FIGS. 1 and 2, there is illustrated a cooling construction of the fixing belt 531. FIG. 1 is a sectional view of the fixing apparatus 5, and FIG. 2 is a partially sectional top plan view of a portion of the image forming apparatus excluding the fixing roller 510 as viewed from above.

The fixing apparatus 5 of this embodiment shown in FIG. 1 has, as described above, the fixing roller 510 with the halogen heaters 520, and the belt unit 53 pressure-contacting the recording material P to the fixing roller 510. This fixing apparatus 5 heat-fixes the not-yet-fixed toner image to the recording material P.

As shown, in FIG. 1, the fixing apparatus 5 has further partition walls 601 to 605 disposed so as to surround the fixing belt 531, for controlling air from naturally entering into around the fixing belt 531, and a cooling unit for cooling the fixing belt 531 in a closed space 600 formed by the partition walls 601 to 605. These partition walls 601 to 605 are made of resin with high heat insulating property, which prevents the heat from transmitting from the fixing-roller into the closed space 600.

In FIG. 1, reference numerals 601, 602, and 603 designate the above-mentioned partition walls, in which reference numeral 601 designates a base frame; 602, an inlet guide leading a recording material P having a not-yet-fixed toner image formed thereof, to the fixing nip W; and 603, an outlet guide leading the recording material P separated by the separating roller 533 to a portion downstream of the conveyance path.

The inlet guide 602 and the outlet guide 603 are disposed in the vicinity of the surface of the fixing belt 531, and fixedly supported on the base frame 602. More specifically, the inlet guide 602 and the outlet guide 603 are disposed in the vicinity of the surface of the fixing belt 531 on a side of the fixing roller 510, so as to cover all upper portion the separating roller 533 and an upper portion of the inlet roller 532 of the fixing belt 531.

In FIG. 2, reference numerals 604, 605 designate the above-mentioned partition walls, in which reference numeral 604 designates a front frame; and 605, a rear frame. The front frame 604 and the rear frame 605 rotatably support the inlet roller 532, the separating roller 533, the steering roller 534 (refer to FIG. 1) and the like through bearings. The front frame 604 and the rear frame 605 are fixedly supported on the base frame 601, as is the case with the inlet guide 602 and the outlet guide 603.

The above-mentioned partition walls, that is, the base frame 601, the inlet guide 602, the outlet guide 603, the front frame 604, and the rear frame 605 surround the fixing belt 531 to thereby form the closed space 600 so as to prevent the air from naturally entering into around the fixing belt 531. According to this embodiment, as shown in FIGS. 1 and 2, the closed space 600 is formed by a portion of the fixing belt 531 except the fixing nip W opposed to the fixing roller 510 and its vicinity Further, the cooling unit has, as shown in FIGS. 1 and 2, a supply duct 612 for supplying the air to the closed space 600 from below by a supply fan 613, cooling fans 611 for blowing the air from the supply fans 612 toward the fixing belt 531, and a discharge duct 614 for discharging the air from an upper portion of the closed space 600 by a discharge fan 615.

The cooling fans 611 is fixed in the closed space 600 below the fixing belt 531, and arranged so as to blow the air in a direction perpendicular to a surface of the fixing belt 531. These cooling fans 611 operate during the recording material passing operation, thereby preventing the fixing belt 531 from receiving the heat from the fixing roller 510 to rise in temperature too much, when the recording material is not in the fixing nip W.

The supply duct 612 aims to take the air into the closed space 600 from below, as described above. This supply duct 612 is connected to a lower portion of the closed space 600 on a front side of the fixing apparatus. Further, the supply duct 612 has an outlet and its vicinity of such a shape as that the air is led to the cooling fan 611. Also, the supply fan 613 is arranged at a portion intermediate of the supply duct 612.

On the other hand, the discharge duct 614 aims to discharge the air from the closed space 600, as described above. This discharge duct 614 is connected to an upper portion of the closed space 600, as shown in FIG. 1, and so constructed to easily discharge the hot air to the outside of the fixing apparatus. Further, the discharge fan 615 is arranged at a portion intermediate of the discharge duct 614.

The construction is made such that a discharge amount per unit time of said air discharged through the discharge duct 614 is more than a supply amount per unit time of the air supplied by the supply duct 612. That is, the discharge fan 615 is greater in air volume than the supply fan 613, which prevents the hot air from leaking from the closed space 600 even if the closed space 600 has some apertures.

According to the above-mentioned construction, taking the air into the closed space 600 through the supply duct 612 and then blowing the air to the fixing belt 531 enables the fixing belt 531 to be cooled efficiently, thereby preventing the fixing belt 531 from rising in temperature too much. This prevents the cooling fans 611 arranged in the vicinity of the fixing belt 531 from being damaged due to the heat from the fixing belt 531. Then, it is possible to discharge the hot air warmed by cooling the fixing belt 531 from the closed space without transmitting the heat of the fixing belt 531 to the peripheral members of the fixing apparatus.

That is, according to the present embodiment, it possible to surely cool the fog belt 531 at the closed space 600 to thereby prevent the fixing belt 531 from rising in temperature too much, and to prevent the heat of the fixing belt 531 from transmitting to the peripheral member of the fixing apparatus to thereby adversely effect the peripheral members, which realizes an favorable image.

In the afore-mentioned embodiment, there is exemplified the image heating apparatus which is used for a color image forming apparatus; however, the image heating apparatus may be used for a monochrome image forming apparatus.

Besides, in the afore-mentioned embodiment, the image forming apparatus includes a printer as an example; however, there can be employed another image forming apparatus such as a copy machine, a facsimile apparatus or the like, or further another apparatus such as a complex machine having a combined functions. Further, there can be employed an image forming apparatus which transfers toner images of respective colors on the an intermediate transfer member in a sequential and superimposed manner, and then transfers the toner image born on the intermediate transfer member on to a recording material in block. The image heating apparatus according to the invention can be applied to the above-mentioned various kinds of the image forming apparatuses.

What is claimed is:

1. An image heating apparatus comprising:

a heating rotational member that heats an image on a recording material at a heating nip;

an endless belt that forms said heating nip in association with said heating rotational member;

a housing that surrounds said endless belt excluding where said endless belt forms said heating nip, said housing forming a substantially closed space; and a cooling fan that cools said belt inside said closed space, wherein said housing includes an air supply opening disposed at a lower portion of said closed space and an air discharge opening disposed at an upper portion of said closed space.

2. An image heating apparatus according to claim 1, wherein said housing has an inlet guide that guides the recording material to said heating nip, and an outlet guide that guides the recording material which has passed through said heating nip.

3. An image heating apparatus according to claim 1, further comprising a supply fan that supplies air toward said air supply opening and a discharge fan that discharges air from said air discharge opening.

4. An image heating apparatus according to claim 1, wherein said air supply opening is disposed at one side in a width direction of said endless belt and said air discharge opening is disposed at the other side in the width direction of said endless belt.

5. An image heating apparatus according to claim 1, further comprising a duct that leads air supplied from said air supply opening toward said cooling fan.

6. An image heating apparatus according to claim 3, wherein a discharge amount per unit time of the air discharged by said discharge fan is more than a supply amount per unit time of the air supplied by said supply fan.

7. An image heating apparatus according to claim 1, wherein said housing is made of a heat insulating resin.

* * * * *

UNITED STATES PATENT AND TRADEMARK OFFICE

CERTIFICATE OF CORRECTION

PATENT NO. : 7,308,219 B2
APPLICATION NO. : 11/249457
DATED : December 11, 2007
INVENTOR(S) : Kazuo Shishido It is certified that error appears in the above-identified patent and that said Letters Patent is hereby corrected as shown below:

ON THE TITLE PAGE

At Item (56), Foreign Patent Documents:

"05072926 A" should read --5-72926 A--.
"2001083826 A" should read --2001-83826 A--.
"2004151476 A" should read --2004-151476 A--.

COLUMN 1

Line 65, "lead" should read --lead to--.

COLUMN 3

Line 42, "finished" should read --finishing--.
Line 52, "on to an" should read --onto an--.

COLUMN 4

Line 27, "robber" should read --rubber--.
Line 37, "oil" should read --belt--.
Line 46, "belt 631" should read --belt 531--.
Line 48, "in" should be deleted.
Line 63, "Win" should read --W in--.

COLUMN 5

Line 39, "all" should read --an--; and "the" (second occurrence) should read --of the--.

UNITED STATES PATENT AND TRADEMARK OFFICE

CERTIFICATE OF CORRECTION

PATENT NO. : 7,308,219 B2
APPLICATION NO. : 11/249457
DATED : December 11, 2007
INVENTOR(S) : Kazuo Shishido It is certified that error appears in the above-identified patent and that said Letters Patent is hereby corrected as shown below:

COLUMN 6
Line 1, “is” should read --are--.
Line 59, “a” should be deleted.
Line 61, “an” should be deleted.
Line 63, “born” should read --borne--.

Signed and Sealed this

Seventeenth Day of February, 2009

JOHN DOLL
*Acting Director of the United States Patent and Trademark Office*